US005251408A

United States Patent [19]

Boaz

[11] Patent Number: 5,251,408

[45] Date of Patent: Oct. 12, 1993

[54] GRINDING WHEEL ASSEMBLY

[75] Inventor: Premakaran T. Boaz, Livonia, Mich.

[73] Assignee: Ford Motor Company, Dearborn, Mich.

[21] Appl. No.: 919,313

[22] Filed: Jul. 27, 1992

[51] Int. Cl.[5] ..... B24B 55/02; B24B 5/10

[52] U.S. Cl. ..... 51/267; 51/206.4; 51/206 P

[58] Field of Search ..... 51/206.4, 206 P, 267, 51/204; 125/15

[56] References Cited

U.S. PATENT DOCUMENTS

| | | | |
|---|---|---|---|
| 3,176,675 | 4/1965 | Bomba | 51/206.4 |
| 3,324,607 | 6/1967 | Niemiec | 51/206.4 |
| 3,376,673 | 4/1968 | Metzger | 51/206.4 |
| 3,417,517 | 12/1968 | Rose | 51/356 |
| 3,777,443 | 12/1973 | Shaw | 51/206.5 |
| 4,523,411 | 6/1985 | Freerks | 51/267 |

FOREIGN PATENT DOCUMENTS

| | | | |
|---|---|---|---|
| 0397955 | 11/1990 | European Pat. Off. | 51/206.4 |
| 0772836 | 11/1980 | U.S.S.R. | 51/206 P |
| 872234 | 10/1981 | U.S.S.R. . | |

*Primary Examiner*—Bruce M. Kisliuk
*Assistant Examiner*—Bo Bounkong
*Attorney, Agent, or Firm*—Lorraine S. Melotik; Roger L. May

[57] ABSTRACT

A grinding wheel assembly comprises a grinding wheel, a flange for directing flow of coolant/lubricant against the grinding surface of the grinding wheel, and, in a preferred embodiment, a threaded shaft and nut for securing the flange adjacent the grinding wheel. The flange includes a circumferential trough formed at the periphery thereof for holding a fluid therein by centripetal force during rotation of the assembly and a plurality of apertures for admitting a flow of fluid therethrough to the circumferential trough. Fluid overflows a weir on a wall of the circumferential trough and enters slots formed in the peripheral surface of the grinding wheel.

14 Claims, 2 Drawing Sheets

GRINDING WHEEL ASSEMBLY

FIELD OF THE INVENTION

This invention relates generally to a grinding wheel assembly. More particularly, the invention is directed to a glass sheet edge grinding wheel assembly having improved cooling and lubricating fluid handling capabilities.

BACKGROUND OF THE INVENTION

Grinding wheels are well-known devices for shaping or finishing the edges of planar materials, e.g., glass sheets. A grinding wheel is typically used to shape and finish a rounded or beveled profile into the edge of a glass sheet which is to be used as a door glazing in an automotive vehicle A grinding wheel generally rotates at a high speed to effect the proper shaping of a workpiece. This results in a considerable undesirable build-up of heat. Moreover, the grinding wheel typically picks up particles of debris abraded from the workpiece which accumulate at the working surface of the grinding wheel thereby substantially diminishing its grinding ability and durability Where the workpiece is a glass sheet, fine particles of glass dust tend to become air borne and settle on the major surfaces of the glass sheet. These particles tend to mar the major surfaces of the glass sheet when they are later removed, e.g., by wiping with a cloth. Additionally, the heat and pressure generated at the grinding interface causes glass dust to adhere to the ground surfaces. This adhered glass dust resists removal during the ground glass sheet washing operation, but comes loose while the ground glass sheet is conveyed through a roller hearth furnace. The falling glass dust contaminates the furnace rolls, which in turn mars the surface of the glass sheet. For these reasons, it is desirable to incorporate a fluid such as, for example, a cooling and/or lubricating fluid at the point of contact between the grinding wheel and the workpiece.

U.S. Pat. No. 3,777,443 to Shaw discloses a segmented grinding wheel, comprising a wheel having a peripheral recess for receiving and securing grinding segments. Additionally, a pair of flanges cooperate with the wheel to define troughs for receiving a cooling fluid. Upon rotation of the grinding wheel, the fluid is urged by centrifugal force through small internal passages from the troughs to the base of the peripheral recess. These small passages, however, can easily become blinded by the particles abraded from the workpiece during the grinding operation, and thereafter must be removed by a reaming operation to reestablish the flow of coolant from the troughs to the base of the peripheral recess.

Russian patent 872,234 discloses a similar grinding wheel assembly, wherein apertures are provided in the wheel flanges to allow a flow of cooling fluid from trough-shaped channels to the base of the grindstone. These apertures may also become blinded by particles abraded from the workpiece.

U.S. Pat. No. 3,417,517 to Rose discloses a grinding apparatus, wherein water is supplied through passages in a grinding wheel flange to the inner peripheral surface of the porous grinding wheel.

It would be desirable to prepare a grinding wheel assembly, wherein a fluid may be delivered to the point of contact between the grinding wheel and the workpiece via apparatus having a configuration which does not easily become blinded by abraded particles and which may easily be cleaned and reused.

SUMMARY OF THE INVENTION

Accordant with the present invention, there surprinsingly has been discovered a novel grinding wheel assembly, comprising: (a) a grinding wheel, including a plurality of parallel, spaced-apart, transverse slots formed in a peripheral surface thereof; (b) a flange adjacent a major surface of the grinding wheel, including a circumferential trough formed at the periphery thereof for holding a fluid therein by centripetal force during rotation of the assembly, and a plurality of apertures in the flange for admitting a flow of fluid therethrough to the circumferential trough; and (c) means for securing the flange adjacent the grinding wheel.

The grinding wheel assembly of the present invention is particularly well-suited for grinding and shaping the edges of glass sheets to prepare automotive and architectural glazings.

BRIEF DESCRIPTION OF THE DRAWINGS

The novel features which are characteristic of the present invention are set forth with particularity in the appended Claims. The invention itself, however, both as to structure and method of assembly will best be understood from the accompanying description of specific embodiments, when read in connection with the drawings, in which:

DETAILED DESCRIPTION OF THE PREFERRED EMBODIMENT

Figure 1:
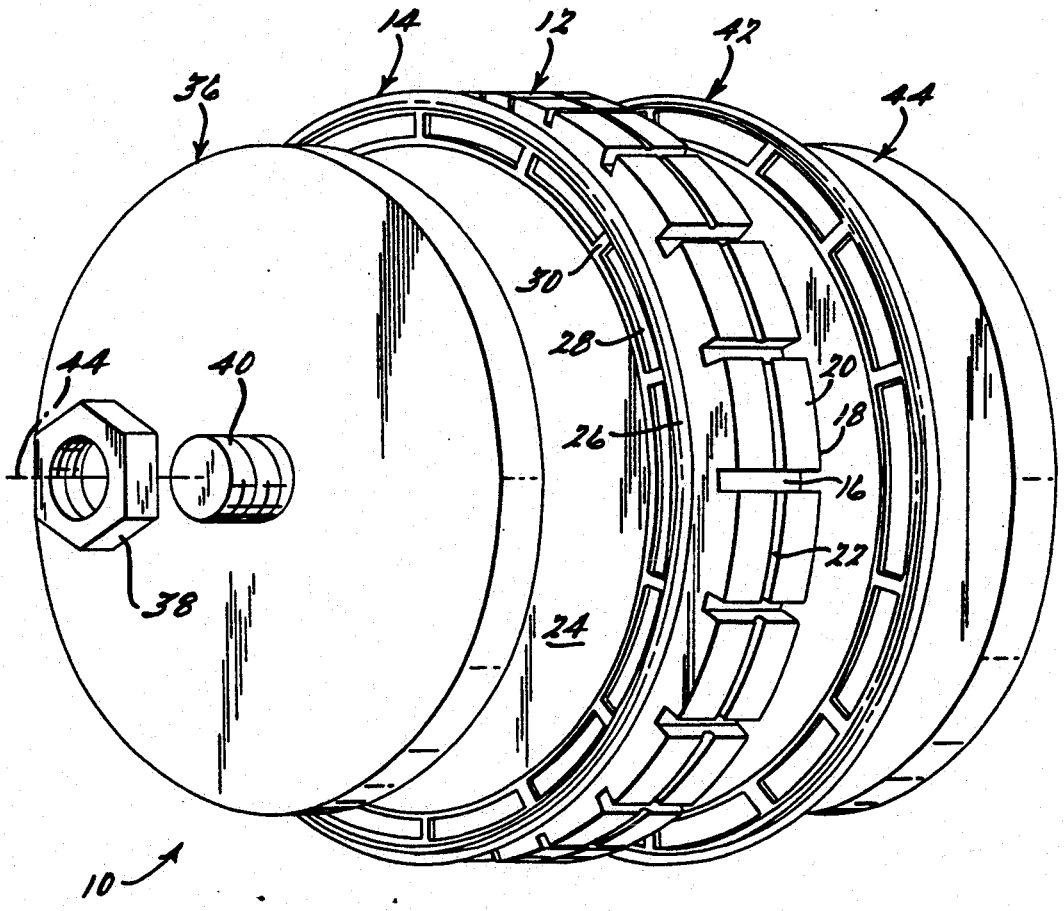
FIG. 1 is an exploded perspective view of a grinding wheel assembly according to the present invention.

Referring now to the drawings, and particularly to FIG. 1, there is shown generally at 10 a grinding wheel assembly according to the present invention, comprising, inter alia, a grinding wheel 12, a flange 14, and means for securing the flange 14 adjacent the grinding wheel 12. The grinding wheel 12 may be formed from any abrasive material such as silicon carbide, diamond, carborundum, aluminum oxide, etc., as well as mixtures thereof. The grinding wheel 12 may be molded from a mixture of the abrasive material and a resin such as, for example, a phenol-formaldehyde thermoset material. Alternatively, the grinding wheel 12 may comprise a metal wheel core having an abrasive material formed around the periphery thereof.

The grinding wheel 12 includes a plurality of parallel, spaced-apart, transverse slots 16 formed in the peripheral surface of the wheel 12. By the term "transverse," as it is used herein, it is meant that the slots extend from one major surface of the wheel 12 to the other major surface, and may be perpendicular to the major surfaces of the grinding wheel 12, skewed, curved, zig-zag, or any other configuration generally known as useful in the grinding wheel art. These slots 16 extend radially inwardly toward the center of the wheel 12, thereby defining radially outwardly extending teeth 18 around the periphery of the wheel 12. Each tooth 18 includes a grinding surface 20 at its outer periphery. The slots 16 create nongrinding areas adjacent the grinding surfaces 20 of the wheel 12, and thereby greatly reduce friction and heating during the grinding operation, and provide for the elimination of abraded particles. The slots 16 communicate a fluid such as, for example, a cooling/lubricating fluid to the interface between the workpiece and the grinding surfaces 20, as will more fully be explained hereinafter. The slots 16 also carry away from the workpiece abraded particles which otherwise would be retained on the grinding surfaces 20.

In an alternative embodiment of the present invention which is particularly useful for shaping and finishing the edges of glass sheets, a circumferential channel 22 is formed in the peripheral surface of the grinding wheel 12. The circumferential channel 22 may be an integral part of the grinding surface 20, or, in the case of glass sheet edge grinding, the circumferential channel 22 may serve as the grinding surface which contacts the workpiece. The profile of the channel 22 may be rounded or beveled, or configured with any shape desired for the ultimately finished edge of the glass sheet.

Figure 2:
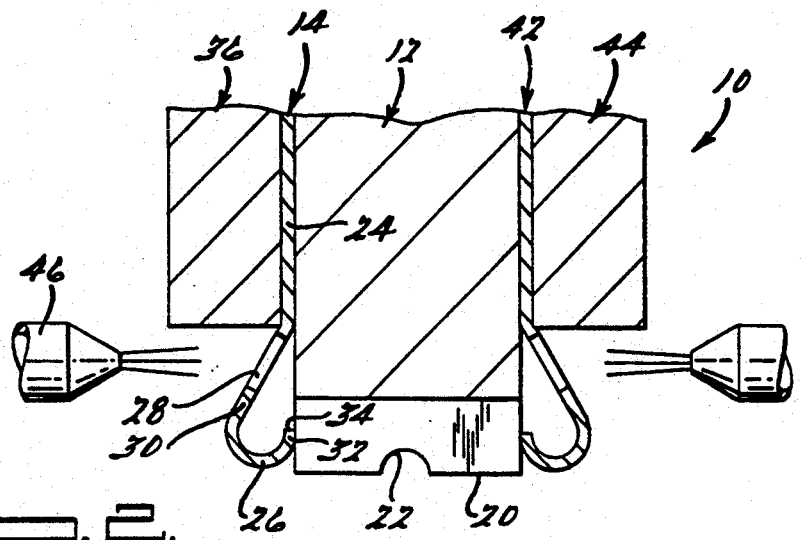
FIG. 2 is a fragmentary cross-sectional view of the grinding wheel assembly of FIG. 1.
Figure 5:
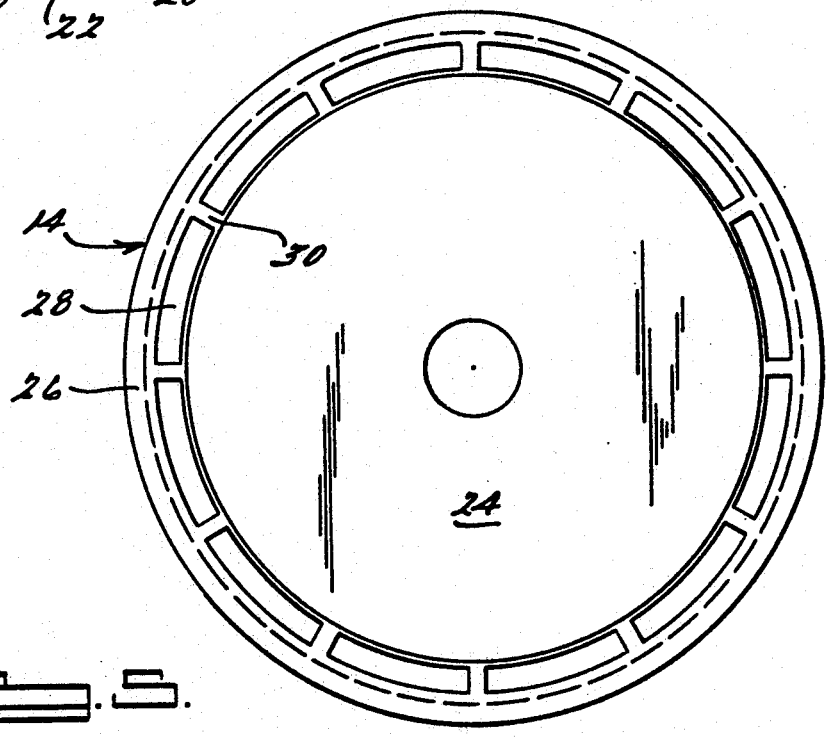
FIG. 5 is a plan view of the flange of the grinding wheel wheel assembly of FIG. 1.

The flange 14, as illustrated in FIGS. 1, 2, and 5, comprises generally a circular plate portion 24 and a circumferential trough 26 formed at the periphery thereof. The circumferential trough 26 is adapted to hold a fluid therein, e.g., a coolant or lubricant, by centripetal force during rotation of the grinding wheel assembly 10. The flange 14 additionally includes a plurality of apertures 28 for admitting a flow of fluid therethrough to the circumferential trough 26. The apertures 28 are formed in a wall portion 30 of the flange 14 which extends between the circular plate portion 24 and the circumferential trough 26. One side wall 32 of the circumferential trough 26 terminates to form a weir 34 which contacts an end of the slots 16 and a side of the teeth 18. During operation of the grinding wheel assembly 10, fluid contained in the trough 26 may flow over the weir 34 laterally into the slots 16 of the grinding wheel 12.

The flange 14 is secured against the grinding wheel 12 by means of a hub 36 which clampingly engages the flange 14 against the grinding wheel 12. The hub 36 is urged against the flange 14 and maintained thereagainst by means of a nut 38 rotatably received on a threaded shaft 40 extending through the center of the hub 36, flange 14, and grinding wheel 12. In a preferred embodiment of the grinding wheel assembly 10, as illustrated in FIG. 1, a second flange 42 is secured adjacent the other major surface of the grinding wheel 12, utilizing a second hub 44 for clampingly engaging the second flange 42 against the grinding wheel 12. The second hub 44, in the case where two flanges 14 and 42 are employed in the assembly 10, or the grinding wheel 12, in the case where only a single flange 14 is used, is urged against a mounting plate (not shown) which is affixed to the shaft 40 and maintained thereagainst by tightening the nut 38, as is well-known in the grinding wheel mounting art. It will be readily apparent to those ordinarily skilled in the art that other well-known means for securing the flange 14 adjacent the grinding wheel 12 may be used in place of the hub 36, nut 38, and threaded shaft 40. For example, the flange 14 may be bolted directly to the grinding wheel 12, especially where the central portion of the grinding wheel 12 is made from metal and affixed to the shaft 40.

During operation, the grinding wheel assembly 10 is rotated about an axis 44 which passes through the grinding wheel 12, by means of a drive mechanism such as an electric motor (not shown). The speed may vary over wide limits from about 1,000 to about 10,000 revolutions per minute, and is generally in the range of about 3,500 revolutions per minute for glass sheet edge grinding. A flow of fluid such as, for example, a coolant or lubricant is directed via one or more nozzles 46 through the apertures 28 where, due to the angular velocity of the assembly 10, it is held in the circumferential trough 26 of the flange 14. Eventually, as more fluid is directed through the apertures 28, it collects in the circumferential trough 26, overflows the weir 34, and enters the slots 16 of the grinding wheel 12 where it contacts the workpiece at the interface between the workpiece and the grinding surfaces 20. Finally, the grinding surfaces 20 are brought into contact with the workpiece.

The present invention is particularly useful for shaping and finishing the edges of a glass sheet. The unfinished edge of the glass sheet is moved relative to the grinding wheel assembly 10 in a direction perpendicular to the axis of rotation of the grinding wheel 12. The edge of the glass sheet is ground by the grinding surfaces 20 of the wheel 12, and is finished with the profile of the circumferential channel 22 against which the glass sheet edge is directed. Any fluid known in the art as useful for grinding glass edges may be used such as, for example, glass grind 100 from J&B Industrial Fluids Co. of Indiana. The grinding and finishing of glass sheet edges is well-known in the art and will not be discussed further herein.

The use of a flange 14 which is separate from the grinding wheel 12, according to the present invention, has several advantages over the fluid handling systems of the grinding wheel assemblies of the prior art. the grinding wheel 12 can be simply cast or formed without having to construct internal fluid passages designed to carry fluid to the slots 16, which could easily blind due to an accumulation of abraded particles. The flange 14 may easily be removed from the assembly for cleaning, and may be re-used many times as worn grinding wheels 12 are replaced. Moreover, the flange 14 may easily be formed from sheet stock, and does not require extensive precision machining.

Figure 3:
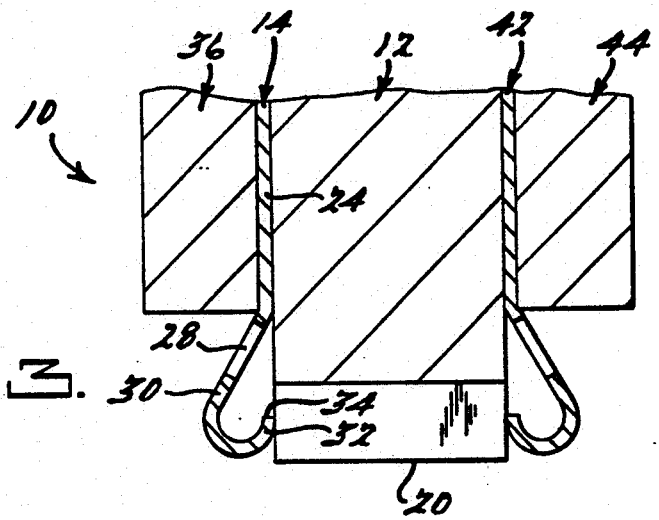
FIG. 3 is a fragmentary cross-sectional view of an alternative embodiment of a grinding wheel assembly.

FIG. 3 illustrates a grinding wheel assembly in which the grinding surfaces 20 are laterally continuous, and do not include by a circumferential channel in the peripheral surface of the grinding wheel 12.

Figure 4:
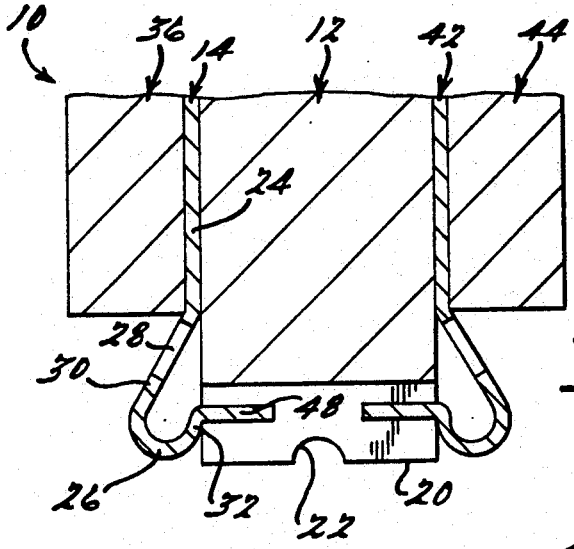
FIG. 4 is a fragmentary cross-sectional view of yet another embodiment of a grinding wheel assembly.

FIG. 4 illustrates a particularly preferred embodiment of the present invention which is highly useful in conjunction with an assembly 10 having a circumferential channel 22 in the peripheral surface of the grinding wheel 12. Fingers 48 extend into the slots 16 generally axially inwardly toward the center of the grinding wheel 12, from the terminal end of the side wall 32 of the circumferential trough 26 a distance sufficient to allow substantially all of the fluid which overflows from the trough 26 to be directed into the slot 16 in the vicinity of the circumferential channel 22 in the grinding wheel 12. The fingers 48 have a width substantially equivalent to the width of the slots 16. The fingers 48 may be parallel with the rotational axis 44, as illustrated in FIG. 4, or may be inclined toward the circumferential channel 22.

From the foregoing description, one ordinarily skilled in the art can easily ascertain the essential characteristics of the present invention, and without departing from the spirit and scope thereof, can make changes and modifications in the invention to adapt it to various usages and conditions.

I claim:

1. A grinding wheel assembly, comprising:

a) a grinding wheel having two spaced-apart major surfaces, including a plurality of parallel, spaced-apart transverse slots formed in a peripheral surface of the grinding wheel;

b) a flange adjacent a major surface of the grinding wheel, including a circumferential trough formed at the periphery of the flange for holding a fluid therein by centripetal force during rotation of the assembly and a plurality of apertures in the flange for admitting a flow of fluid therethrough to the circumferential trough wherein the trough opens directly into the slots of the grinding wheel; and c) means for securing the flange adjacent the grinding wheel.

2. The grinding wheel assembly according to claim 1, wherein the grinding wheel includes a circumferential channel formed in the peripheral surface thereof.

3. The grinding wheel assembly according to claim 2, wherein the circumferential channel has a rounded profile.

4. The grinding wheel assembly according to claim 1, wherein a side wall of the circumferential trough terminates to form a weir.

5. The grinding wheel assembly according to claim 4, wherein the weir contacts an end of the slots.

6. The grinding wheel assembly according to claim 1, wherein the means for securing the flange adjacent the grinding wheel includes a hub for clampingly engaging the flange against the grinding wheel, a threaded shaft extending through the center of the hub, flange, and grinding wheel, and a nut rotatably received on the threaded shaft.

7. The grinding wheel assembly according to claim 1, further including a second flange adjacent another major surface of the grinding wheel, and means for securing the second flange adjacent the grinding wheel.

8. The grinding wheel assembly according to claim 1, wherein the flange includes a plurality of fingers extending into the slots, directed axially, from a terminal end of a side wall of the circumferential trough.

9. A glass sheet edge grinding wheel assembly, comprising:

a) a grinding wheel having two spaced-apart major surfaces, including a circumferential channel and a plurality of parallel, spaced-apart, transverse slots formed in a peripheral surface of the grinding wheel;

b) first and second flanges adjacent the major surfaces of the grinding wheel, each flange including a circumferential trough formed at the periphery of the flange for holding a fluid therein by centripetal force during rotation of the assembly and a plurality of apertures in the flange for admitting a flow of fluid therethrough to the circumferential trough wherein the trough opens directly into the slots of the grinding wheel; and c) means for securing the flanges adjacent the grinding wheel.

10. The glass sheet edge grinding wheel assembly according to claim 9, wherein a side wall of the circumferential trough of each flange terminates to form a weir.

11. The glass sheet edge grinding wheel assembly according to claim 10, wherein the weir of each flange contacts an end of the slots.

12. The glass sheet edge grinding wheel assembly according to claim 9, wherein the means for securing the flanges adjacent the grinding wheel includes first and second hubs for clampingly engaging the flanges against the grinding wheel, a threaded shaft extending through the center of the hubs, flanges, and grinding wheel, and a nut rotatably received on the threaded shaft.

13. The glass sheet edge grinding wheel assembly according to claim 9, wherein each flange includes a plurality of fingers extending into slots, directed axially, from the terminal end of the side wall of the circumferential trough.

14. A glass sheet edge grinding wheel assembly, comprising:

a) a grinding wheel having two spaced-apart major surfaces, including a circumferential channel having a rounded profile and a plurality of parallel, spaced-apart, transverse slots formed in a peripheral surface of the grinding wheel;

b) first and second flanges adjacent the major surfaces of the grinding wheel, each flange including a circumferential trough formed at the periphery of the flange for holding a fluid therein by centripetal force during rotation of the assembly and a plurality of apertures in the flange for admitting a flow of fluid therethrough to the circumferential trough, and a plurality of fingers extending into the slots, directed axially, from a terminal end of a side wall of the circumferential trough wherein the trough opens directly into the slots of the grinding wheel; and c) means for securing the flanges adjacent the grinding wheel, including first and second hubs for clampingly engaging the flanges against the grinding wheel, a threaded shaft extending through the center of the hubs, flanges, and grinding wheel, and a nut rotatably received on the threaded shaft.

* * * * *